US005909925A

United States Patent [19]

Glockl

[11] Patent Number: 5,909,925

[45] Date of Patent: Jun. 8, 1999

[54] ROCKER STOOL WITH CONTACT MEANS CENTRALLY ARRANGED BELOW THE SEAT

[76] Inventor: Josef Glockl, Ammerseestrasse 6, 85551 Kirchheim, Germany

[21] Appl. No.: 08/875,815

[22] PCT Filed: Jan. 30, 1996

[86] PCT No.: PCT/EP96/00376

§ 371 Date: Aug. 5, 1997

§ 102(e) Date: Aug. 5, 1997

[87] PCT Pub. No.: WO96/24274

PCT Pub. Date: Aug. 15, 1996

[30] Foreign Application Priority Data

Feb. 8, 1995 [DE] Germany ..... 195 04 121

[51] Int. Cl.[6] ..... A47C 1/02

[52] U.S. Cl. ..... 297/314; 297/195.11; 297/195.14

[58] Field of Search ..... 297/314, 325, 297/311, 195.11, 259.4, 264.1, 302.4; 248/130, 133, 371, 372.1, 629

[56] References Cited

U.S. PATENT DOCUMENTS

| | | | |
|---|---|---|---|
| 4,099,697 | 7/1978 | Von Schuclkmann | 297/314 X |
| 4,183,579 | 1/1980 | Gonzalez y. Rojas | 297/195.11 |
| 4,932,719 | 6/1990 | Gonzalez y. Rojas | 297/195.11 X |

FOREIGN PATENT DOCUMENTS

| | | | |
|---|---|---|---|
| 1480037 | 5/1996 | France . | |
| 19 81 518 | 3/1968 | Germany . | |
| U 7531129 | 10/1975 | Germany . | |
| 28 43 175 | 4/1980 | Germany . | |
| 82 06 113 | 5/1982 | Germany . | |
| 3201335 | 7/1983 | Germany | 297/195.11 |
| 32 07 941 | 9/1983 | Germany . | |
| 42 10 098 | 9/1993 | Germany . | |
| 42 10 099 | 9/1993 | Germany . | |
| WO 93/19645 | 10/1993 | Germany . | |

*Primary Examiner*—Laurie K. Cranmer
*Attorney, Agent, or Firm*—Stroock & Stroock & Lavan LLP

[57] ABSTRACT

The device concerns a rocking stool comprising a seat surface 1 and a support structure 6 having a base 3, wherein arranged at the base end of the support structure 6 is a contact means 5 which can be pressed against the floor when the rocking stool is loaded and which is arranged centrally beneath the seat surface and which serves as a support in the rocking movement. The contact surface is pressed against the floor when the stool is loaded by virtue of elastic deformation of the support devices arranged on the support structure 6 and thus provides such a good frictional connection between the rocking stool and the floor that a travel movement of the rocking stool during the rocking movement is prevented.

30 Claims, 8 Drawing Sheets

ROCKER STOOL WITH CONTACT MEANS CENTRALLY ARRANGED BELOW THE SEAT

FIELD OF THE INVENTION

The invention concerns a rocking stool having a seat surface and a support structure having a base means.

BACKGROUND OF THE INVENTION

Rocking stools are already known for example from DE 42 10 098.4-16, having a hinge-like arrangement between the seat surface and the base means. The base means in those stools is of the same kind as that found in conventional chairs, seats the like.

A disadvantage with the above rocking stools according to the state of the art is that, when the stools are moved, they cannot be pulled over the floor, but have to be lifted and carried.

Rocking stools are also known in which the base means has rollers. Although such rocking stools can admittedly be easily moved over the floor, they move considerably over the floor when the person sitting on the stool rocks.

SUMMARY OF THE INVENTION

The object of the present invention is thus to provide a rocking stool which can be easily pushed or pulled over the floor without loading but which affords firm contact relative to the floor when loaded so as to prevent movement over the floor during the rocking movement.

In accordance with the present invention the object is attained by a contact means which is arranged substantially centrally beneath the seat surface and which can be brought into pressing contact with the floor when the stool is loaded and which serves as a support means in the rocking movement.

The major part of the force due to weight is transmitted by way of the contact means disposed centrally beneath the seat surface. As a result, the pressure in relation to surface area, at the contact surface between the contact means and the floor, is so high as to ensure that the rocking stool grips the floor in the optimum fashion.

A further advantage of the invention is that the centre point about which the rocking movement takes place can be at the point of contact between the contact means and the floor. That design configuration provides the desired optimum rocking radius, in a very inexpensive structure.

In accordance with a very desirable embodiment the contact means is connected to the base means by way of a frame, at least one strut or the like, wherein when a loading is applied the frame, strut or like experiences elastic deformation to such an extent that the contact means is pressed against the floor.

In an advantageous development the spacing between the contact means and the floor in the non-loaded condition may be adjusted.

In an alternative development the necessary force required for deformation of the strut and thus the force for pressing the contact means against the floor may be adjusted.

Both the possibility of adjusting the spacing and also the force serve in an ideal fashion for adaptation to the body weight of the person using the stool. That is particularly important when the person using the stool would like to only slightly relieve the loading on the stool in order to move it or roll it to another location. In that respect it is important that just a slight relief of the loading on the rocking stool will already cause the contact means to lift away from the floor.

Desirably the contact means is made from a material with a high coefficient of friction. Such materials are elastomers such as for example rubber. It is highly advantageous for the contact means to be in the form of a hemispherical pressure knob, with the spherical part thereof being pressed against the floor.

In a preferred embodiment the vertical axis of the contact means moves in the rocking movement in accordance with the vertical axis of the stool. In that construction the point of contact between the contact means and the floor is at the same time the centre point of the rocking movement.

In an alternative construction the contact means remains in a perpendicular position and the rocking movement of the stool is made possible by virtue of a hinge or pivot above the contact means.

The support structure of the rocking stool may be embodied in a large number of different forms, but a preferred configuration is that of a central pillar or column, at the base end of which the contact means is disposed. An advantage with that structure is that the central pillar transmits the force due to weight directly to the contact means, and in addition a spring and a height-adjustable gas spring can be inexpensively integrated.

In regard to the design configuration of the base means, it is advantageous for the base means to be in the form of a circular ring or a circular ring portion. In such cases the base means may comprise for example a chromium-plated tube which can be easily pulled over a carpet.

An alternative advantageous configuration of the base means comprises at least two circular disk segments arranged in an angular position relative to the floor. The circular disk segments may also be in the shape of the tail fin of a fish.

Advantageously the base means is so designed that it affords good sliding properties in regard to contact with the floor.

In an advantageous configuration of the invention the rocking movement of the stool is made possible by elastic deformation of the frame, the struts, the circular disk segments or the like.

In a similar alternative embodiment the central pillar may have spring legs which permit a rocking movement of the central pillar about the point of contact between the contact means and the floor.

In a further alternative embodiment, rigid support devices or the like may be mounted to the support structure by way of hinge pivots, and the rigid support devices may be pulled by springs towards the support structure as far as a given angle. With that design configuration the rigid support devices are involved in a minimum amount of sliding movement over the floor when the stool is involved in a rocking movement, and the springs ensure that the rocking stool enjoys a high degree of stability in terms of standing on the floor. An advantage with that construction is that, except for the springs, no materials have to be involved in elastic deformation and therefore there is virtually no possibility of fatigue-induced fractures or oscillation-induced cracking fractures.

A further advantageous configuration provides that the base means or the resilient legs or the rigid support devices have rollers, balls or the like so that the rocking stool, in the non-loaded condition, can be easily moved over the floor.

An advantageous development of that configuration involves the rollers, balls or the like on the base means or resilient legs or rigid support devices being resiliently retracted when the stool is subjected to a loading. A specific development provides that the rollers, balls or the like resiliently retract into the base means or resilient legs or rigid support devices in such a way that they can no longer be perceived by an outside observer.

An alternative form of this configuration involves using office chair rollers in accordance with DIN (German Industrial Standard) which are fixed in the non-loaded condition, which can be rolled in a lightly loaded condition and which in the loaded condition are fixed again or are completely retracted.

DESCRIPTION OF THE DRAWING FIGURES

The invention is described in greater detail hereinafter with reference to the drawing in which:

FIG. 1 shows an embodiment of a rocking stool with a base means in the form of a circular ring, in the non-loaded condition, FIG. 2 shows the rocking stool of FIG. 1 in a loaded condition, FIGS. 3, 4 and 5 are partial views of different contact means in a condition of full rocking deflection, FIG. 6 shows an embodiment with a base means comprising circular disk segments, FIG. 7 shows an embodiment with resilient legs, FIG. 8 shows a partial view of an embodiment with rigid support devices which are held by springs, FIGS. 9*a*, 9*b* and 9*c* show embodiments with a base means in the form of a circular ring and rollers in the non-loaded and the loaded conditions, FIG. 10 is a view in section through the circular ring-like support structure with roller in an extended position, FIG. 11 is a view in section through the circular ring-like support structure with ball in an extended position, FIG. 12 shows a rocking stool from FIG. 1 involving an adjustable spacing a or an adjustable deformation force, FIG. 12*a* is a view in section through an adjusting mechanism for adjustability of the spacing a shown in FIG. 12, FIG. 12*b* shows a view in section through an adjusting mechanism for adjustability of the deformation force as shown in FIG. 12, and FIG. 13 is a view in section of an alternative adjusting mechanism for adjustability of the spacing a.

DESCRIPTION OF THE PREFERRED EMBODIMENTS

Figure 1:
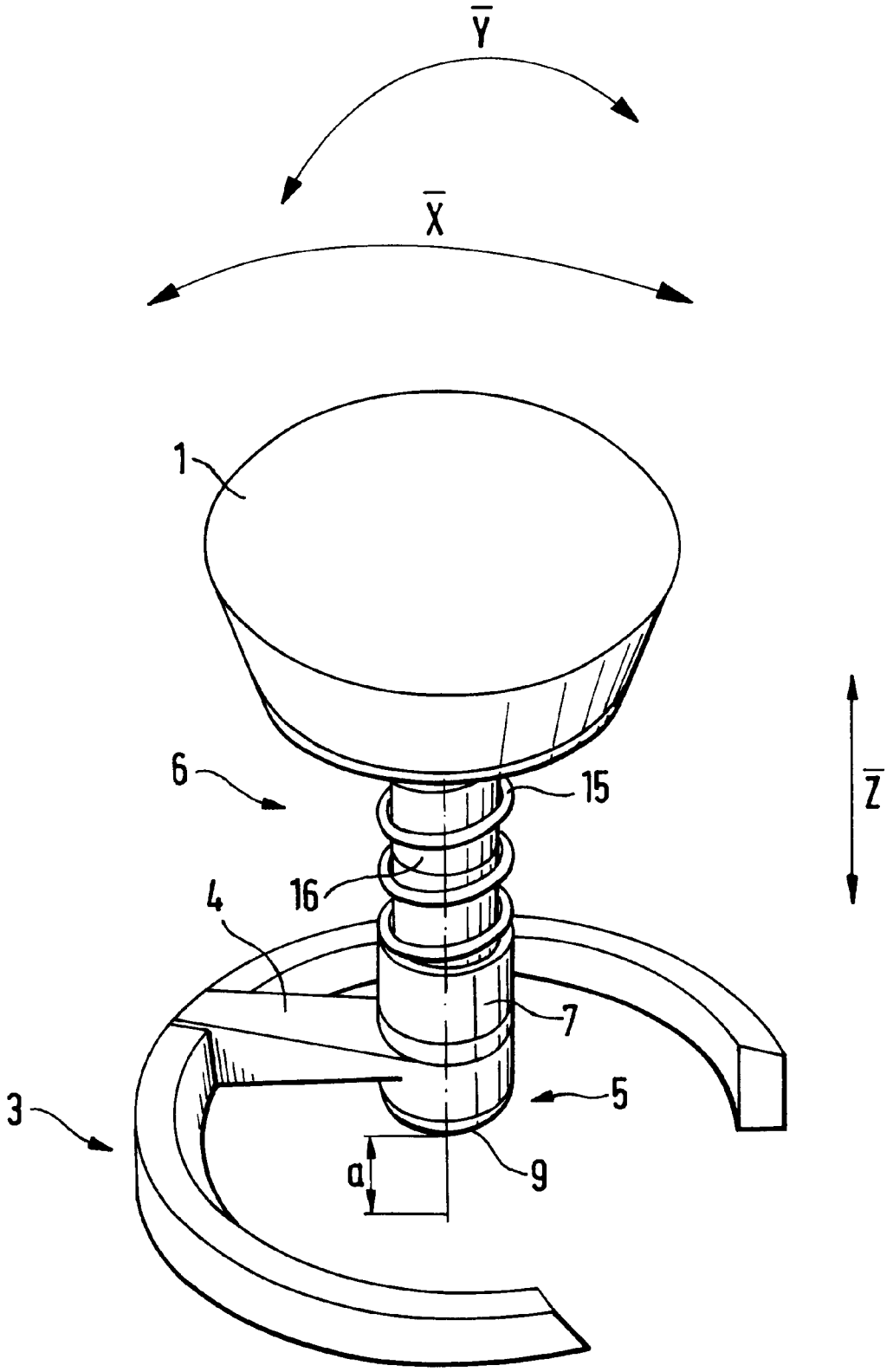

The embodiment of the rocking stool according to the invention shown in FIG. 1 comprises a seat surface 1, a support structure 6 having a base means 3 and a contact means 5 which is arranged centrally beneath the seat surface 1 and which can be pressed against the floor when a loading is applied to the stool and which serves as a support in the rocking movement. The seat surface 1 can rock in the X- and Y-directions and is adjustable in respect of height Z. The seat surface 1 is supported in a vertical direction by a height-adjustable gas spring 16 and a coil spring 15 operatively associated therewith.

In this embodiment the support structure 6 is in the form of a central pillar or column 7, with the contact means 5 being mounted at the base end thereof. The contact means 5 comprises a material with a high coefficient of friction. Such materials are elastomers, for example rubber. In this embodiment the contact means 5 is in the form of a hemispherical pressure knob 9.

The seat surface 1, the support structure 6 and the contact means 5 are connected to the base means 3 by way of a frame, a strut 4 or the like.

In the non-loaded condition the contact means 5 is disposed at a spacing a above the floor. When a loading is applied the frame, strut 4 or the like experiences deformation to such an extent that the contact means 5 or the pressure knob 9 is pressed against the floor.

The elastically deformable frame, strut 4 or the like is connected to the base means which is of an inverted U-shaped profile.

Figure 2:
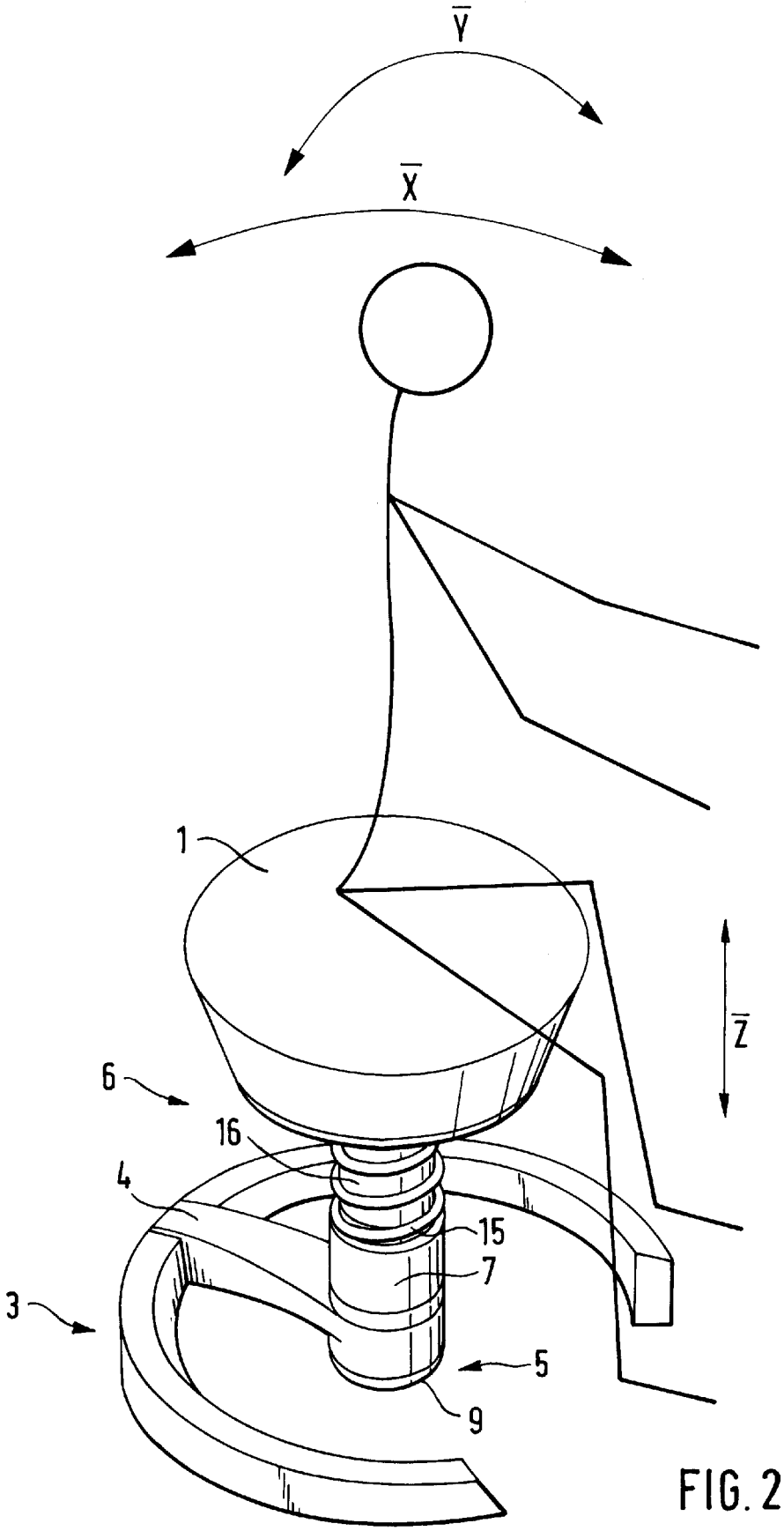

FIG. 2 shows the embodiment of the rocking stool illustrated in FIG. 1, in the loaded condition. In the loaded condition the frame or strut 4 connected to the circular ring portion 22 is elastically deformed until the contact means 5 or the pressure knob 9 is pressed against the floor. The coil spring 15 which is adjustable in terms of its spring hardness and the gas spring 16 are also compressed somewhat under the loading involved, even if to a substantially lesser degree.

Figure 3:
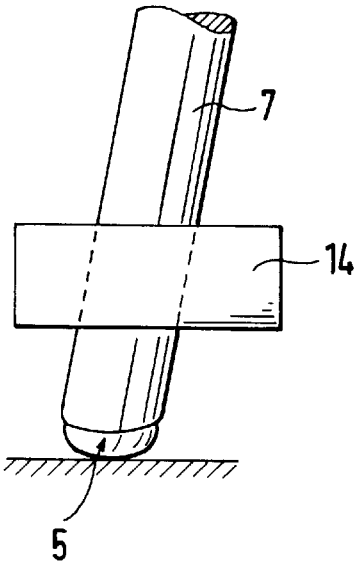
Figure 5:
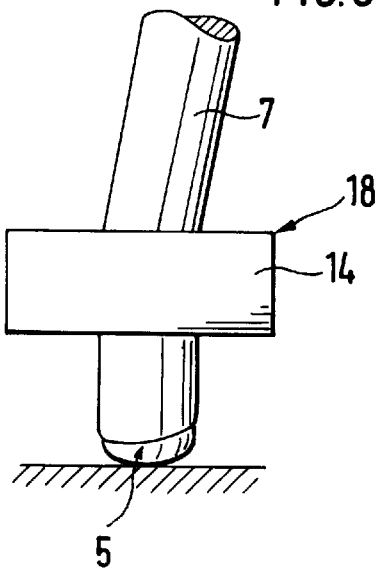
Figure 4:
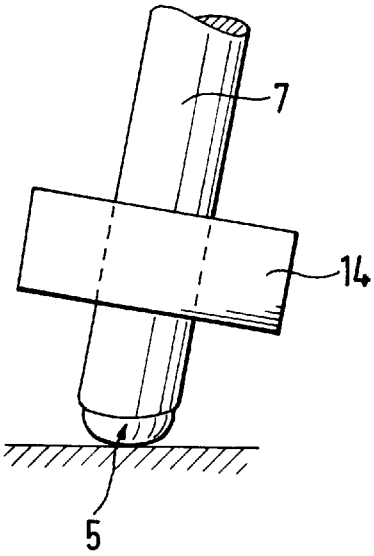

Reference will now be made to FIGS. 3, 4 and 5 showing the central pillar 7, a holder 14 for mounting support devices for the rocking stool and the contact means 5.

In FIG. 3 the central pillar 7 is mounted for universal movement in the holder 14 so that the vertical axis of the contact means 5 performs the same rocking movement as the vertical axis of the central pillar 7. In this case the vertical axis of the holder 14 remains in a perpendicular position.

In FIG. 4 the axis 7 of the central column, the holder 14 and the contact means 5 are fixedly connected together and jointly perform the rocking movements. In this embodiment the rocking movement is made possible by elastically deformable support devices.

In FIG. 5 there is within the holder 14 a hinge or pivot which permits a rocking movement of the central pillar 7 and the components arranged thereabove. The holder 14 and the contact means 5 remain in a perpendicular position during the rocking movement.

Figure 6:
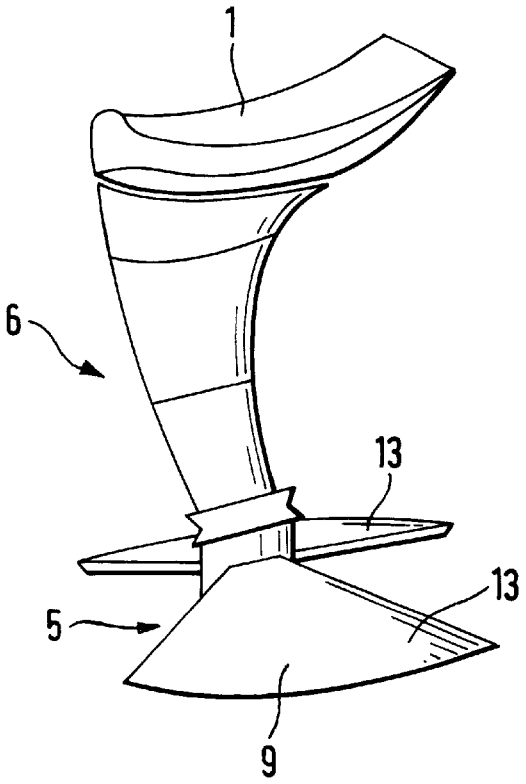

Reference will now be made to FIG. 6 showing a rocking stool with a saddle-like seat surface 1, a curved support structure 6 with integrated gas spring system, a base means 3 comprising circular disk segments 13, and a contact means 5. In the loaded condition, the circular disk segments 13 are deformed elastically until the contact means 5 is pressed against the floor.

Figure 7:
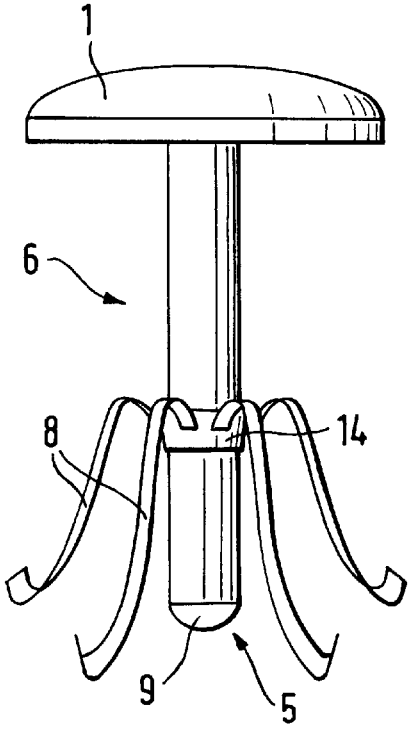

FIG. 7 shows a rocking stool having support devices in the form of resilient legs 8. In the non-loaded condition of the rocking stool the contact means 5 is at a certain spacing above the floor, as in the case of the above-described embodiments. When the rocking stool shown in FIG. 7 is loaded, the resilient legs are deformed elastically until the contact means 5 is pressed against the floor. The resilient legs 8 further perform the function of permitting the rocking movement of the stool and producing a raising moment to bring the rocking stool into an upright position during the rocking movement thereof, by virtue of the resilient elastic deformation of the legs 8. This embodiment of the rocking stool makes use of the principle shown in FIG. 4.

Figure 8:
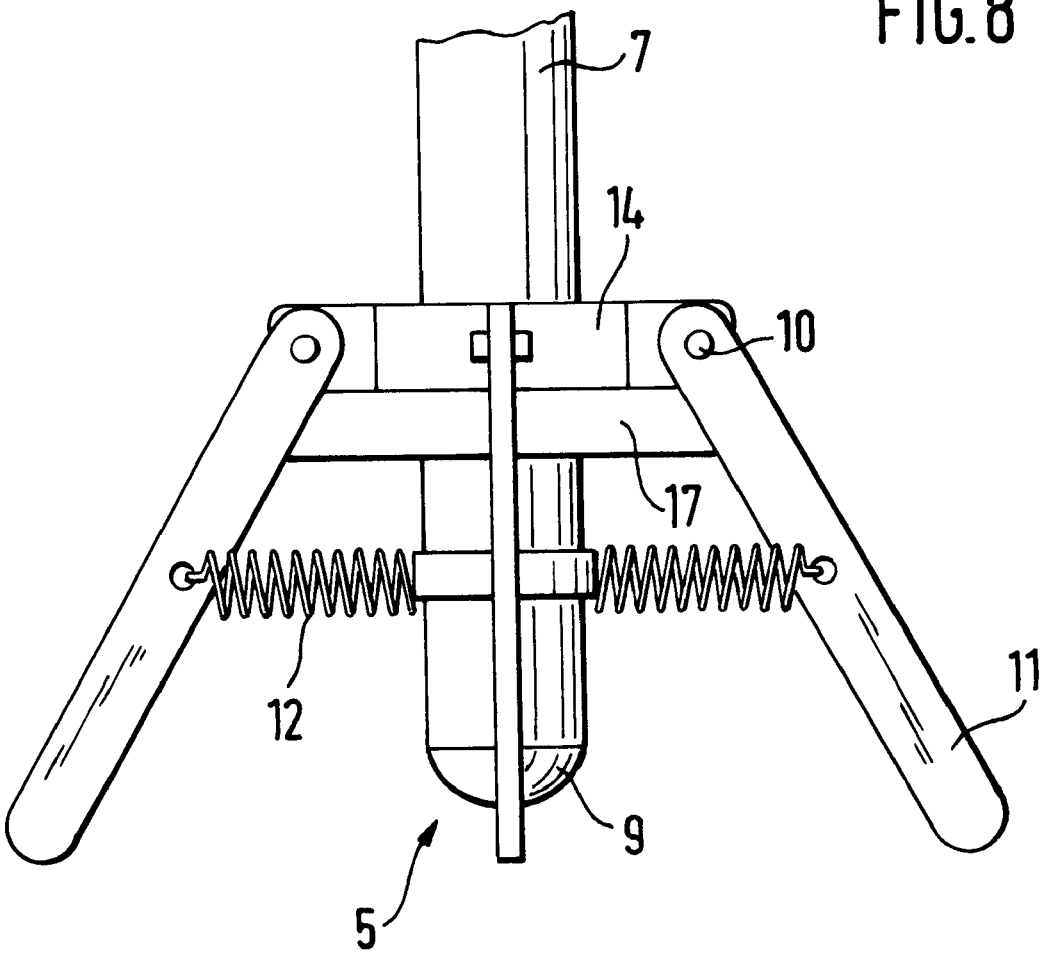

FIG. 8 illustrates a further particular embodiment of a support structure of a rocking stool. Rigid support devices 11 are connected to the holder 14 by way of hinge pivots. The rigid support devices 11 are drawn towards the central pillar 7 by way of tension springs 12, as far as a predetermined angle. The predetermined angle is defined by an abutment 17. In the non-loaded condition the rigid support devices 11 are pulled towards the central pillar 7 by the tension springs 12 until they encounter the abutment 17. When the rocking stool is loaded the central pillar 7 moves downwardly, the ends of the rigid support devices 11 slide over the floor with a radially outwardly spreading movement, and the contact means 5 is pressed against the floor. The rocking movement of the stool and the raising moment for moving it towards the erect position are produced in a similar manner to the configuration shown in FIG. 7, by virtue of the hinge pivots 10 and the tension springs 12. This embodiment also utilises the principle illustrated in FIG. 4.

Figure 9A:
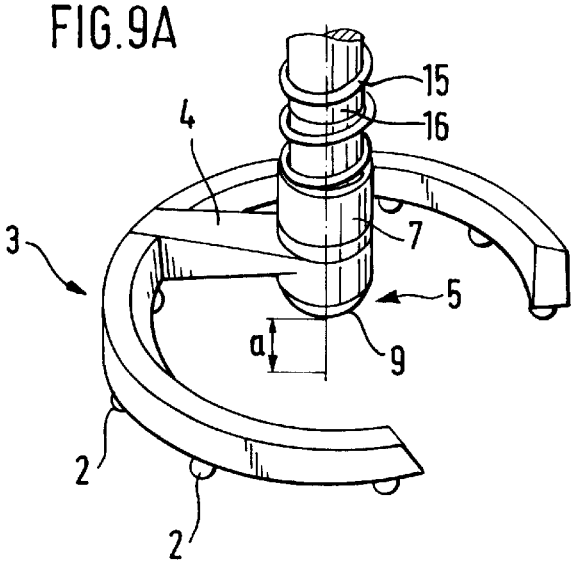

FIG. 9*a*, representatively in respect of all other embodiments of the invention, illustrates the first embodiment with a base means 3 in the form of a circular ring, at the underside of which are arranged rollers, balls 2 or the like so that the rocking stool, in the non-loaded condition, can be more easily moved over the floor.

Figure 9B:
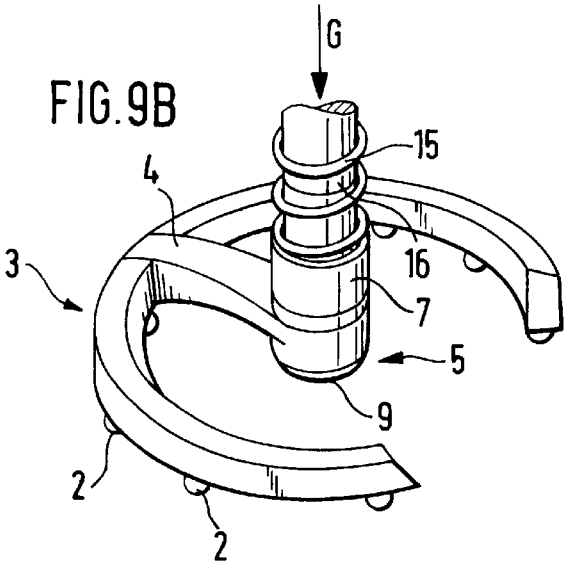

FIG. 9*b* shows a partial view of the rocking stool in the loaded condition. The elastic frame, strut 4 or the like, is deformed under the effect of the loading until the contact means 5 is pressed against the floor.

Figure 9C:
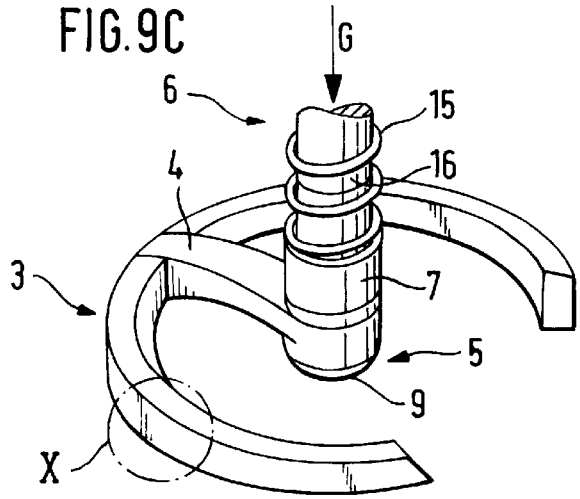

FIG. 9*c* is another partial view showing the rocking stool of FIG. 9*a* in the loaded condition, but in this alternative embodiment the rollers, balls 2 or the like are resiliently retracted into the base means 3 of the rocking stool. The rollers, balls 2 or the like resiliently retract into the base means 3 in such a way that they can no longer be perceived by an outside viewer. In another alternative configuration which is not shown herein, the rollers, balls 2 or the like may also be resiliently retracted in such a way that they are visible from the outside. It is also possible to use office chair rollers in accordance with DIN (German Industrial Standard) which are fixed in the non-loaded condition, which can be rolled in the lightly loaded condition, and which are again fixed or totally resiliently retracted, in the loaded condition.

Figure 10:
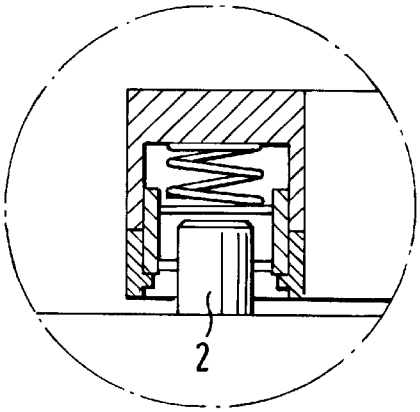
Figure 11:
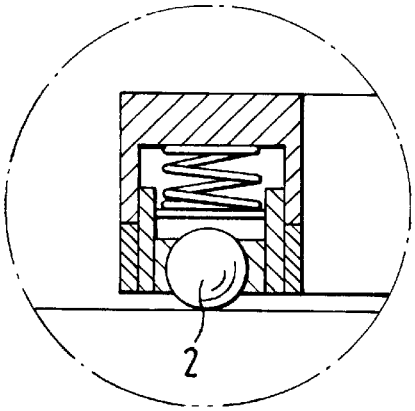

FIGS. 10 and 11 show views in section through the detail X in FIG. 8. The circular ring portion 22 constituting the base means 3 is in the form of a U-shaped profile, with the springing mechanism being disposed in the interior of the U-shape. FIG. 10 shows an embodiment with rollers, while FIG. 11 shows an embodiment with balls.

Figure 12:
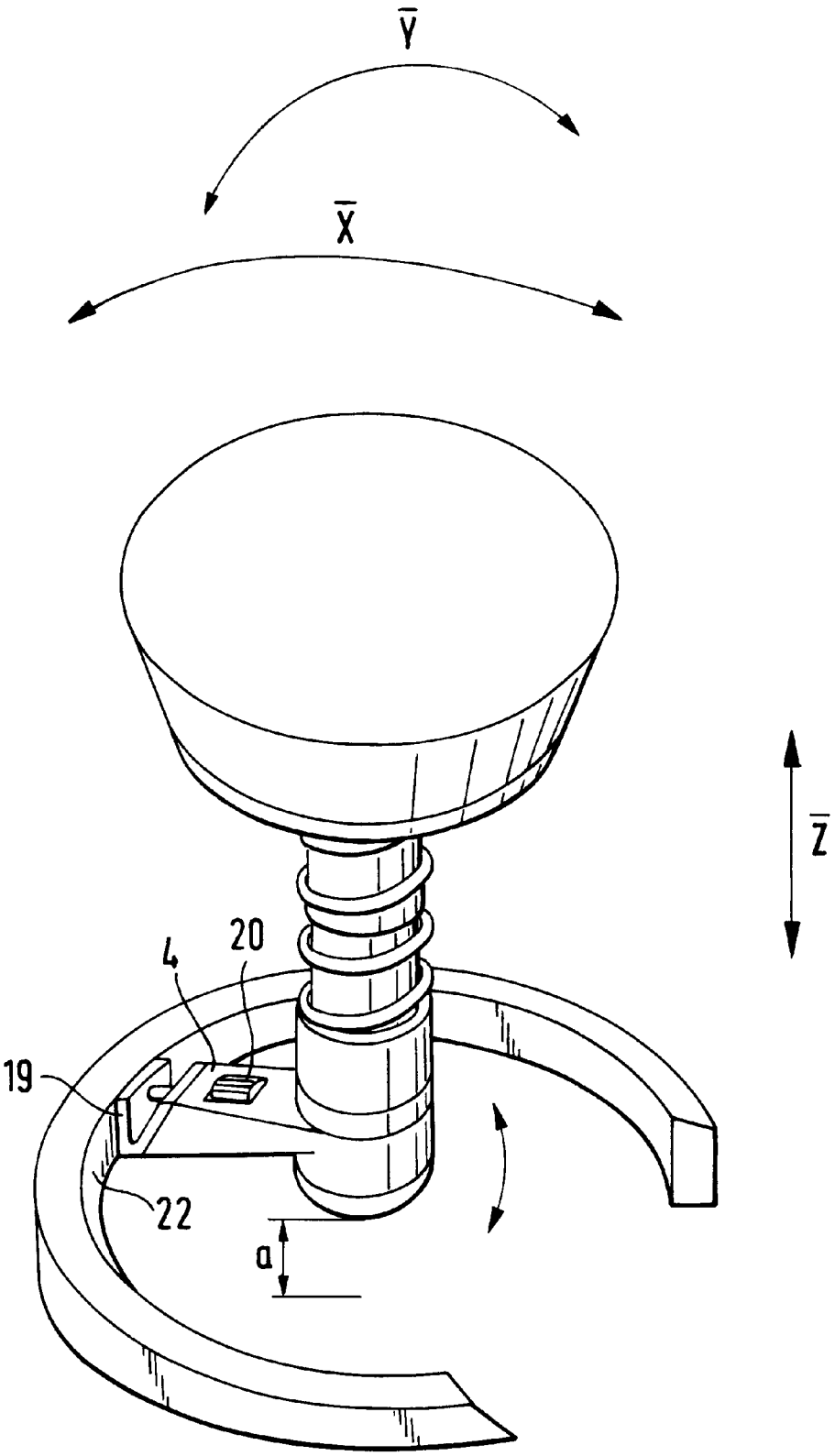

FIG. 12 shows the rocking stool shown in FIG. 1, wherein a spring angle portion 19 is disposed between the strut 4 and the circular ring portion 22 of the base means 3. The spring angle portion 19 comprises spring steel and is connected both to the circular ring portion 22 and also to the strut 4 by way of rivets. The circular ring portion 22, the spring angle portion 19 and the strut 4 are additionally connected by way of a screw 21 and which cooperates with an adjusting wheel 20 for adjusting the opening angle or the opening force of the spring angle portion 19. The adjusting wheel 20 is integrated in the strut 4 and can be operated by way of a suitable opening at the top side of the strut 4.

Figure 12A:
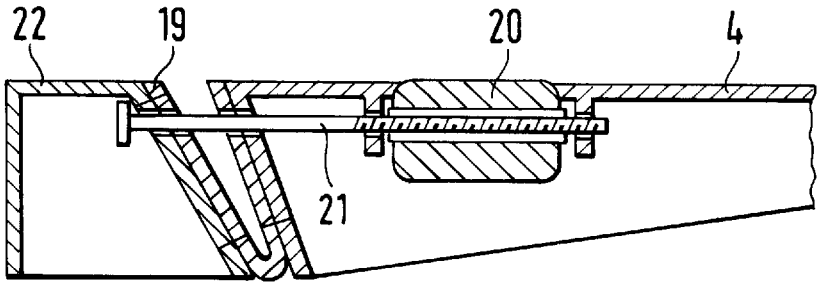

FIG. 12*a* shows a view in section through an adjusting mechanism for adjusting the spacing a between the contact means 5 and the floor, as illustrated in FIG. 12. The screw 21 is extended through the circular ring portion 22 of the base means 3, through the spring angle portion 19 and through the end of the strut 4, and, depending on the setting of the adjusting wheel 20, defines the maximum opening angle of the spring angle portion 19. The heavier the person using the rocking stool is, the greater the screw 21 must be tightened and the more the angle formed by the spring angle portion 19 must be closed. That gives a greater spacing a between the contact means 5 and the floor and therefore a higher force must be applied to produce elastic deformation of the strut 4, in order to press the contact means 5 against the floor.

Figure 12B:
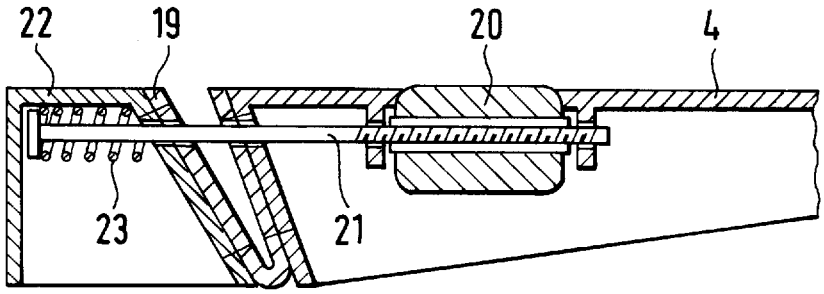

FIG. 12*b* shows an alternative embodiment to that illustrated in FIG. 12*a*, in which it is not the spacing a between the contact means 5 and the floor, but the force for expanding the spring angle portion 19, that can be adjusted. In this embodiment the screw 21 is prestressed against the force of a spring 23 by way of the adjusting wheel 20 so that the spring force of the spring angle portion 19 can be increased in relation to the weight of the person using the stool. The spring 23 is disposed between the head of the screw 21 and the inside surface of the circular ring portion 22.

Figure 13:
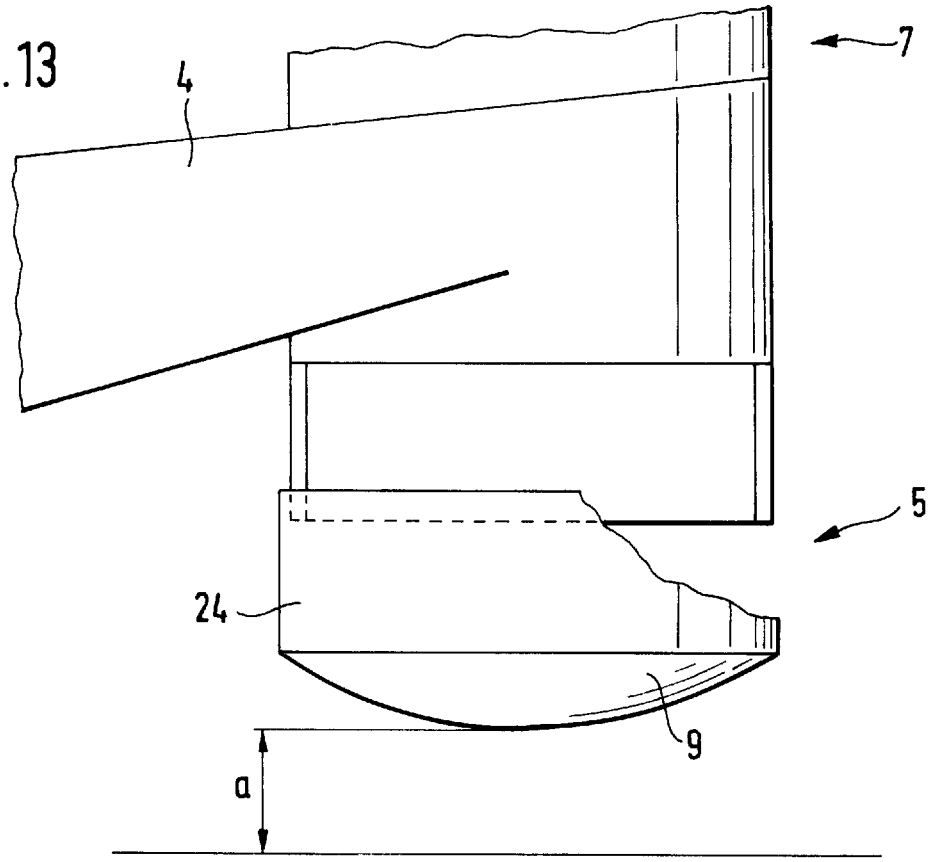

FIG. 13 shows a further alternative form of structure for adjusting the spacing a between the contact means 5 and the floor. The contact means 5 at the lower end of the central pillar 7 is in the form of a cup-shaped nut member 24 with the pressure knob 9 at the underside thereof. For the purposes of adjusting the spacing a the nut 24 is screwed up or down on a corresponding male screwthread at the lower end portion of the central pillar 7.

I claim:

1. A rocking stool comprising:

a seat surface;

a support structure having a base means; and contact means which can be brought into pressing contact with the floor when the rocking stool is loaded, said contact means being arranged substantially centrally beneath the seat surface and serving as a support means in the rocking movement, the contact means remaining in a perpendicular position in the rocking movement of the stool.

2. Apparatus as set forth in claim 1, wherein the base means is connected to the contact means by way an elastically deformable component.

3. Apparatus as set forth in claim 2, wherein the rocking movement of the stool is made possible by elastic deformation of the elastically deformable component.

4. Apparatus as set forth in claim 1, wherein the contact means comprises a material with a high coefficient of friction.

5. Apparatus as set forth in claim 1, wherein the contact means is made from an elastomer.

6. Apparatus as set forth in claim 5, wherein the elastomer is rubber.

7. Apparatus as set forth in claim 1 wherein the contact means is in the form of a hemispherical pressure knob.

8. Apparatus as set forth in claim 1, wherein a vertical axis of the contact means moves in the rocking movement in accordance with a vertical axis of the stool.

9. Apparatus as set forth in claim 1, wherein the support structure is in the form of a central pillar and the contact means is arranged at a base end of the central pillar.

10. Apparatus as set forth in claim 1, wherein the base means is slideable relative to the floor.

11. Apparatus as set forth in claim 1, wherein the base means further comprises rollers for permitting rolling movement of the base means along the floor.

12. Apparatus as set forth in claim 11, wherein the rollers are resiliently retractable into the base means.

13. A rocking stool comprising:

a seat surface;

a support structure having a base means, the base means being in the form of a circular ring which is held by at least one strut; and contact means which can be brought into pressing contact with the floor when the rocking stool is loaded, said contact means being arranged substantially centrally beneath the seat surface and serving as a support means in the rocking movement.

14. Apparatus as set forth in claim 13, further comprising adjusting means by means of which the necessary force for elastic deformation of the strut and thus for pressing the contact means against the floor is adjustable.

15. Apparatus as set forth in claim 13, further comprising adjusting means arranged between the circular ring and the strut.

16. Apparatus as set forth in claim 15, wherein the adjusting means has a spring angle portion whose opening angle is adjustable.

17. Apparatus as set forth in claim 15 wherein the adjusting means has a spring angle portion whose opening force is adjustable.

18. A rocking stool comprising:

a seat surface;

a support structure having a base means; and contact means which can be brought into pressing contact with the floor when the rocking stool is loaded, said contact means being arranged substantially centrally beneath the seat surface and serving as a support means in the rocking movement a spacing between the contact means and the floor being adjustable in a non-loaded condition.

19. A rocking stool comprising:

a seat surface;

a support structure having a base means the base means being in the form of at least two circular disk segments arranged in an angular position relative to the floor; and contact means which can be brought into pressing contact with the floor when the rocking stool is loaded, said contact means being arranged substantially centrally beneath the seat surface and serving as a support means in the rocking movement.

20. Apparatus as set forth in claim 19, wherein the rocking movement of the stool is made possible by elastic deformation of the circular disk segments.

21. A rocking stool comprising:

a seat surface;

a support structure having a base means; and contact means which can be brought into pressing contact with the floor when the rocking stool is loaded, said contact means being arranged substantially centrally beneath the seat surface and serving as a support means in the rocking movement, the support structure being in the form of a central pillar and the contract means being arranged at a base end of the central pillar and resilient legs arranged on the central pillar, said resilient legs permit a rocking movement of the central pillar about a contact point between the contact means and the floor.

22. Apparatus as set forth in claim 21, wherein the resilient legs have rollers for permitting rolling movement of the legs along the floor.

23. Apparatus as set forth in claim 22, wherein the rollers are resiliently retractable on the resilient legs.

24. A rocking stool comprising:

a seat surface;

a support structure having a base means; and contact means which can be brought into pressing contact with the floor when the rocking stool is loaded, said contact means being arranged substantially centrally beneath the seat surface and serving as a support means in the rocking movement; and arranged on the support structure by way of hinge pivot joints, are rigid support devices which are biased towards the support structure to a given angular extent.

25. Apparatus as set forth in claim 24, wherein the rigid support devices have rollers for permitting rolling movement of the support devices along the floor.

26. Apparatus as set forth in claim 25, wherein the rollers are resiliently retractable on the rigid support devices.

27. A rocking stool comprising:

a seat surface;

a support structure having a base means; and contact means which can be brought into pressing contact with the floor when the rocking stool is loaded, said contact means being arranged substantially centrally beneath the seat surface and serving as a support means in the rocking movement, the base means being connected to the contact means by way of an elastically deformable component, the elastically deformable component being a frame.

28. A rocking stool comprising:

a seat surface;

a support structure having a base means; and contact means which can be brought into pressing contact with the floor when the rocking stool is loaded, said contact means being arranged substantially centrally beneath the seat surface and serving as a support means in the rocking movement wherein the base means is connected to the contact means by way of an elastically deformable component the elastically deformable component is at least one strut.

29. Apparatus as set forth in claim 28, wherein the rocking movement of the stool is made possible by elastic deformation of the strut.

30. A rocking stool comprising:

a seat surface;

a support structure having a base means, the base means being in the form of a circular ring portion which is held by at least one strut; and contact means which can be brought into pressing contact with the floor when the rocking stool is loaded, said contact means being arranged substantially centrally beneath the seat surface and serving as a support means in the rocking movement.

* * * * *